US005935507A

United States Patent [19]

Morito et al.

[11] Patent Number: 5,935,507

[45] Date of Patent: Aug. 10, 1999

[54] MULTI-POINT LASER TRAPPING DEVICE AND THE METHOD THEREOF

[75] Inventors: Yuhkoh Morito, Tokyo; Shuji Shikano; Michinari Hoshina, both of Yokohama, all of Japan

[73] Assignee: Moritex Corporation, Japan

[21] Appl. No.: 08/935,308

[22] Filed: Sep. 22, 1997

Related U.S. Application Data

[63] Continuation of application No. 08/546,741, Oct. 23, 1995, abandoned.

[30] Foreign Application Priority Data

Nov. 11, 1994 [JP] Japan ..... 6-277705

[51] Int. Cl.[6] ..... H05H 3/04

[52] U.S. Cl. ..... 264/482; 250/251; 264/437; 425/174.4

[58] Field of Search ..... 264/1.37, 437, 264/482; 372/20; 250/251; 425/174.4

[56] References Cited

U.S. PATENT DOCUMENTS

| | | | |
|---|---|---|---|
| 3,808,550 | 4/1974 | Ashkin | 250/251 |
| 4,023,158 | 5/1977 | Corcoran | 250/251 |
| 4,188,538 | 2/1980 | Diels . | |
| 4,265,534 | 5/1981 | Remijan . | |
| 4,893,886 | 1/1990 | Ashkin et al. . | |
| 5,013,494 | 5/1991 | Kubo et al. | 264/2.5 |
| 5,071,597 | 12/1991 | D'Amato et al. | 264/482 |
| 5,212,382 | 5/1993 | Sasaki et al. . | |
| 5,386,426 | 1/1995 | Stephens . | |
| 5,512,745 | 4/1996 | Finer et al. | 250/251 |
| 5,689,109 | 11/1997 | Schutze | 250/251 |

*Primary Examiner*—Matthew D. Vargot

*Attorney, Agent, or Firm*—Brown, Martin, Haller & McClain, LLP

[57] ABSTRACT

The present invention involves a multi-point laser trapping device in which laser light is irradiated on medium that includes micro-particles, and captures and arranges multiple micro-particles within said medium simultaneously; and is characterized by irradiating the aforementioned laser light from a single laser light source, and by arranging in that light route grating which forms on medium a diffraction pattern consisting of multiple point laser spots.

10 Claims, 2 Drawing Sheets

MULTI-POINT LASER TRAPPING DEVICE AND THE METHOD THEREOF

This is a continuation of application Ser. No. 08/546,741, filed Oct. 23, 1995, now abandoned.

BACKGROUND OF THE INVENTION

1. Field of the Invention

The present invention is related to a multi-point laser trapping device and the method thereof in which laser light is irradiated on a medium which includes micro-particles, and multiple micro-particles within said medium are simultaneously captured and arranged.

2. Description of the Related Art

In recent years, there have been proposals for technology related to laser trapping in which laser light is irradiated on micro-particles on the micrometer order which are included in a medium, and the particles are manipulated without contract by the momentum received and transferred by refracting that light acting on the micro-particles, and capturing the micro-particles; and this is applied to manipulating and processing macromolecular substances on the molecular level, and to bio-engineering type cellular manipulations, etc.

Now then, initially, single micro-particles within the medium were captured by the laser light, but recently, there have also been proposals for technology relating to multi-point laser trapping in which interference patterns of the laser light are formed on the medium using a Mach-Zehnder interferometer, a Fabris Perot interferometer, or a Michaelson interferometer, etc. and multiple micro-particles within the medium are simultaneously captured.

FIG. 3 is a conventional multi-point laser trapping device which utilizes a Mach-Zehnder interferometer as the interference pattern format on means, and Mach-Zehnder interferometer 23 is formed an the light route of the laser light which is irradiated from Argon laser 21 onto preparation 22. Mach-Zehnder interferometer 23 uses half mirror 24 to split the laser light in two, and after these respective light beams are reflected by mirrors 25 and 26, both are irradiated on half mirror 27, and interference patterns are formed on lens 28 by the interference of the two light beams based on the fact that both mirrors are slightly tilted, and this interference pattern is projected on preparation 22 through half mirror 29 and lens 30.

Moreover, preparation 22 is formed by packing medium 34 which includes micro-particles 33,33 in between slide glass 31 and cover glass 32, and multiple micro-particles 33 are simultaneously captured and arranged along the is interference patterns formed by Mach-Zehnder interferometer 23.

In addition, 35 is a CCD camera which monitors the behavior of micro-particles 33 within medium 34.

Nonetheless, if interferometer 23 is utilized in this way, because the light intensity is attenuated from the use of two half mirrors 24,27 and two mirrors 25,26 at a minimum, a high output laser such as an Argon laser, YAG laser, or He—Ne laser, etc. must be used, and this involves the problems of a large scale device, and high costs.

Moreover, because the coherence length of an Argon laser, which has a narrow spectrum width, is about 50 mm, it is possible to form interferometer 23 by splitting the light with half mirror 24. However, there is a problem with small scale, inexpensive lasers such as laser diodes which have a wide spectrum width in that it is extremely difficult to actually form the interferometer because the coherence length is just a few mm. Moreover, mirrors 24,25,26 and 27 which are utilized in the optical system of Mach-Zehnder interferometer 23 are easily affected by displacement caused by minute vibrations.

SUMMARY OF THE INVENTION

Thus, the present invention addresses the technical issue of utilizing a laser light source that is small scale, has a weak output, and a short coherence length, and that can simultaneously capture and arrange multiple micro-particles.

In order to solve these problems, the present invention: involves a multi-point laser trapping device which irradiates laser light on a medium that includes micro-particles, and simultaneously captures and arranges multiple micro-particles within said medium; and is characterized by irradiating the aforementioned laser light from a single laser light source, and arranging a grating that forms on the medium a diffraction pattern consisting of multi-point laser spots.

According to the present invention, because multiple laser spots are projected on the medium by laser light irradiated from a single laser light source being irradiated on a grating arranged in the light route to form a diffraction pattern using the light that has passed through that grating, multiple micro-particles are simultaneously captured by those laser spots along the diffraction pattern.

At this time, because the diffraction pattern is formed by the laser light passing through the grating arranged on that light route, the diffraction pattern can be formed on the medium irrespective of the length of the laser light source coherence length.

Also, because the diffraction pattern is not formed by laser light being shaded as in a mask pattern, but rather is formed by the phenomenon of light diffraction, there is little light loss, and laser spots with a comparatively strong light intensity can be obtained even using a laser light source with a weak output such as a laser diode.

Below, the present invention will be specifically explained based on the embodiments indicated in the diagrams.

BRIEF DESCRIPTION OF THE DRAWINGS

The present invention will be better understood from the following detailed description of preferred embodiments of the invention, taken in conjunction with the accompanying drawings, in which like reference numerals refer to like parts, and in which.

DETAILED DESCRIPTION OF THE PREFERRED EMBODIMENTS

Figure 1:
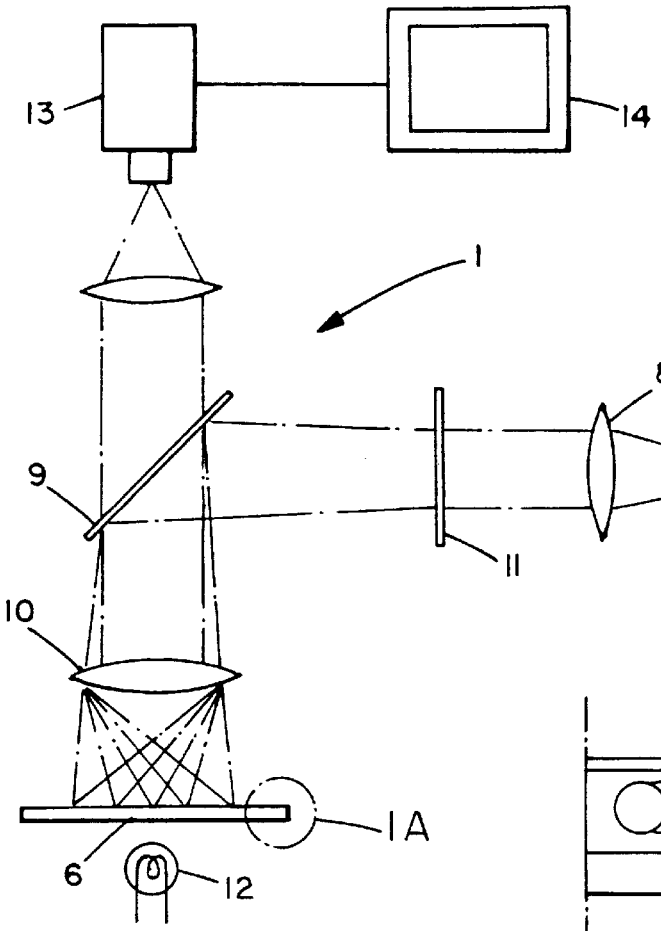
FIG. 1 is an explanatory diagram indicating a multi-point laser trapping device related to the present invention.
Figure 1A:
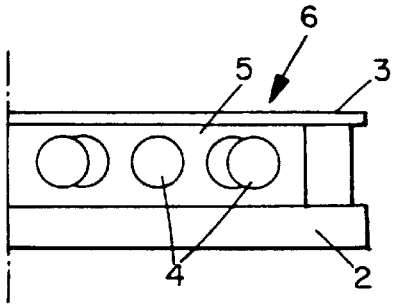
FIG. 1A is an enlarged view of the circle portion labeled 1A in FIG. 1.

In the diagram, 1 is a multi-point laser trapping device in which laser light is irradiated on preparation 6 in which medium 5 which includes micro-particles 4 is packed between slide glass 2 and cover glass 3, and multiple micro-particles 4 within said medium 5 are simultaneously captured and arranged; and for example, the light route may be formed by oscillating laser light from a laser diode (laser light source) with an oscillation wave length of 830 nm; this is collimated by collimation lens 8, reflected by dichroic mirror 9, passed through condenser lens 10, and reaches the aforementioned preparation 6.

Then, grating 11, which allows laser light to pass through and form on medium 5 the specified diffraction pattern consisting of multi-point laser spots, is arranged between collimation lens B and dichroic mirror 9 on the aforementioned light route; and multiple laser spots formed by the diffraction pattern are irradiated on medium 5.

This grating 11 is formed by a well-known method, for example, etching, photoresist, beam etching, optical holography, replication using these as the original plate, or hot sputtering.

Furthermore, it is also possible to use a fiber grating in which glass fibers are lined up in parallel, or a micro lens grating in which micro lenses are lined up in the specified arrangement.

Figure 2A:
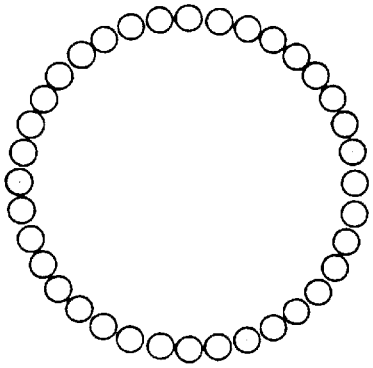
FIGS. 2(*a*)–2(*c*) are an explanatory diagrams indicating examples of diffraction patterns.
Figure 2C:
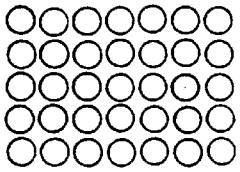
Figure 2B:
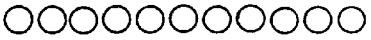
Figure 3:
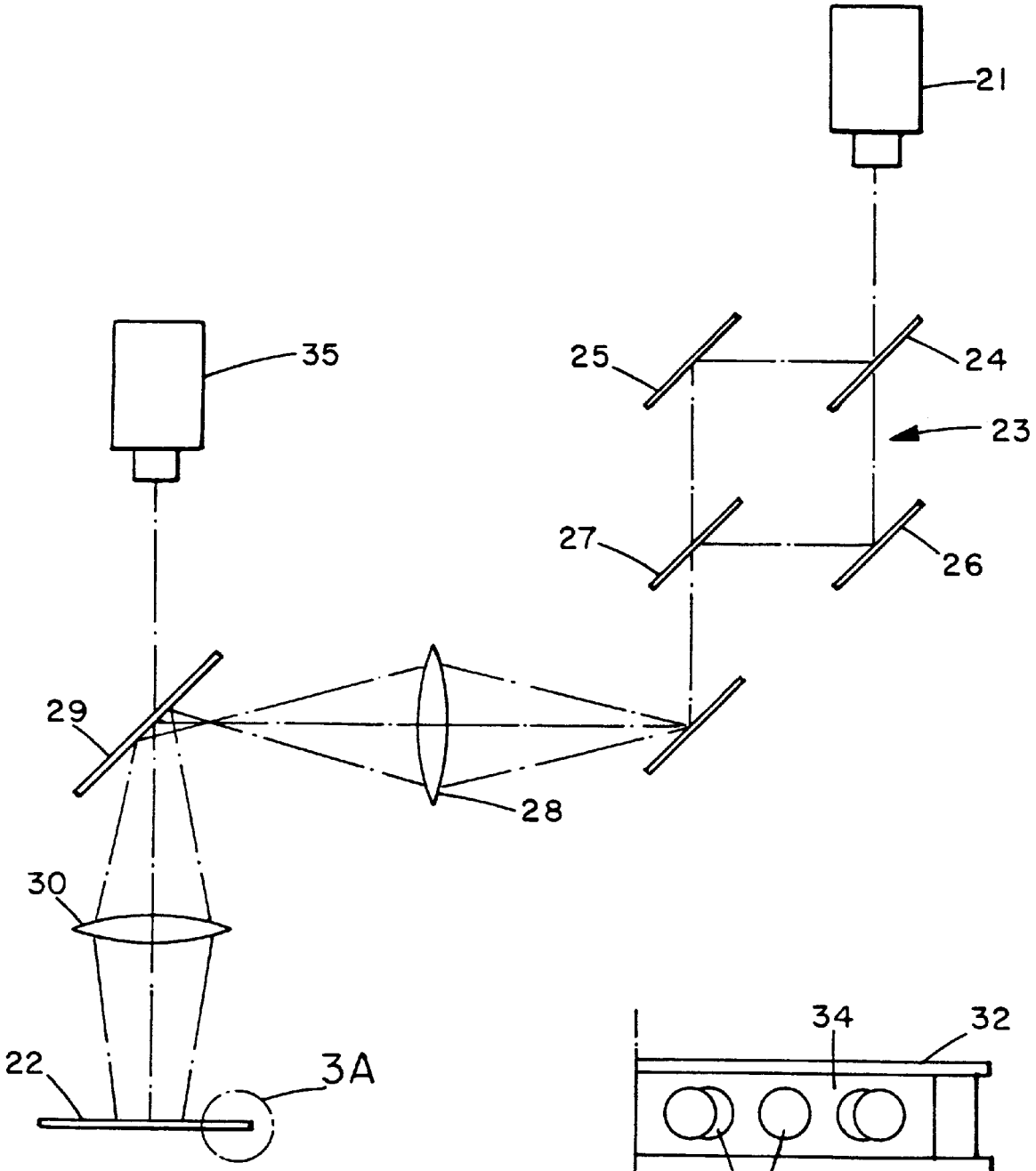
FIG. 3 is an explanatory diagram indicating a conventional device.
Figure 3A:
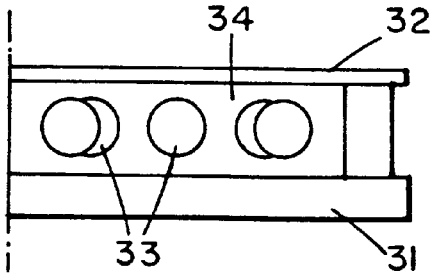
FIG. 3A is an enlarged view of the circled portion labeled 3A in FIG. 3.

Using a device in which, for example, concentric circular shaped contours with a pitch of 100$\mu$ are formed radially as grating 11, when irradiating laser light on the center of that concentric circle, a diffraction pattern in which laser spots are lined up in a circle are formed as indicated in FIG. 2(*a*).

Moreover, when using a fiber grating with a sandwich structure in which 25$\mu$ diameter glass fine lines 7 with a high refractive index are placed between two glass plates 8 using an adhesive with a low refractive index, a diffraction pattern in which laser spots are arranged linearly at the specified intervals are formed as indicated in FIG. 2(*b*).

In addition, 12 is a light source which irradiates light of a visible light wave length from below preparation 6; 13 is a CCD camera for the purpose of observing the behavior of micro-particles 4 on preparation 6; and 14 is a display device to monitor that video image.

The above is an example of a configuration of the present invention, and now the laser trapping method utilized by this device 1 will be explained.

First, the laser light oscillated from laser diode 7 is collimated by collimation lens 8, and passes through grating 11.

Then, if utilizing, for example, a grating 11 in which concentric circular-shaped contours are formed, a diffraction pattern in which laser spots are lined up in a circular shape as indicated in FIG. 2(*a*) is formed by the laser light which passes through said grating 11.

Because the laser light which forms this diffraction pattern has a comparatively long wave length, it is reflected by dichroic mirror 9, and the diffraction pattern is illuminated on aforementioned preparation 6 by passing through condenser lens 10.

Specifically, when the diffraction pattern in which laser spots are lined up in a circular shape as indicated in FIG. 2(*a*) is formed on preparation 6, multiple micro-particles 4 within medium 5 are captured and arranged by the laser spots.

Then, by sweeping the diffraction pattern, not only is it possible to select only micro-particles of the specified diameter and to select only ones with a large refractive index, but by arranging micro-particles 4 in a circular shape, it is also possible to enclose and capture non-transparent particles, index particles, and large diameter particles which normally cannot be laser trapped using said micro-particles 4.

Also, if using a grating in which a diffraction pattern is formed by lining laser spots up linearly as indicated in FIG. 2(*b*), the particles are arranged following that pattern.

In addition, if using a grating in which a diffraction pattern is formed by lining up laser spots in a grid at a specified pitch as indicated in FIG. 2(*c*), the particles are arranged following that pattern, a micro-sphere lens plate can be formed by securing this using a well-known method, and this grating plate, etc. can be used as a diffraction lattice.

At this time, the patterns of laser spots which are simultaneously illuminated on multiple points, are not formed by a beam splitter and masking pattern, but rather are formed using a grating to diffract laser light oscillated from laser diode 7. Therefore, there is almost no loss of light; it is not necessary to use an interferometer; and it is possible to reliably form a diffraction pattern even with a laser having a comparatively short coherence length such as laser diode 7.

As described above, according to the present invention, because a diffraction pattern consisting of multi-point laser spots is formed by laser light passing through a grating, it is possible to irradiate comparatively bright laser spots simultaneously on multiple points without having to use a large scale, long coherence length laser light source and an interferometer. Consequently, there is the vastly superior effect that multiple micro-particles within a medium can be captured and arranged simultaneously even using a small scale laser light source with a weak output and a short coherence length.

Although some preferred embodiments of the invention have been described above by way of example only, it will be understood by those skilled in the field that modifications may be made to the disclosed embodiments without departing from the scope of the invention, which is defined by the appended claims.

We claim:

1. A multi-point laser trapping device, comprising:

a single laser light source for directing a laser light beam along a light path;

a medium including micro-particles arranged in said laser light path, whereby multiple micro-particles within said medium are simultaneously captured and arranged; and a diffraction grating arranged in the light path between said laser light source and the medium, the diffraction grating comprising a plate of light transmissive material having a flat surface, a series of grooves formed in said flat surface in a predetermined pattern for forming a predetermined complex diffraction pattern on said medium, the diffraction pattern comprising a plurality of spaced laser spots arranged in at least one line.

2. The device as claimed in claim 1, wherein the light source is a laser diode, and a collimation lens is located in said light path between said laser diode and said grating for collimating the laser light output of said laser diode.

3. A multi-point laser trapping device, comprising:

a single laser light source for directing a laser light beam along a light path;

a medium including micro-particles arranged in said laser light path, whereby multiple micro-particles within said medium are simultaneously captured and arranged; and a diffraction grating arranged in the light path between said laser light source and the medium, the diffraction grating comprising a plate of light transmissive material having a flat surface, a series of concentric, circular-shaped grooves formed on said flat surface for forming a diffraction pattern of laser spots at spaced intervals around a single circle, whereby multiple micro-particles are enclosed and captured.

4. The device as claimed in claim 1, wherein the diffraction grating comprises means for forming a diffraction pattern of laser spots lined up along a single line.

5. The device as claimed in claim 1, wherein the diffraction grating comprises means for forming a diffraction pattern comprising a grid of laser spots.

6. The device as claimed in claim 1, including an additional light source of a visible light wave length positioned to illuminate said medium.

7. The device as claimed in claim 6, wherein said laser light source is directed towards one side of said medium and said additional light source is directed towards the opposite side of said medium.

8. The device as claimed in claim 1, including a dichroic mirror in said light path between said grating and said medium for reflecting said diffraction pattern towards said medium.

9. A multi-point laser trapping method, comprising the steps of:

directing a laser light beam from a laser light source along a light path;

providing a diffraction grating comprising a plate of light transmissive material having a flat surface, a series of grooves in a predetermined pattern arranged over said flat surface;

arranging the diffraction grating in the light path to form a diffraction pattern comprising a plurality of spaced laser spots at spaced intervals around a single circle;

irradiating a medium including micro-particles with said circular diffraction pattern of multi-point laser spots; and capturing and arranging multiple micro-particles of a predetermined diameter with the laser spots, and trapping other micro-particles within the circular pattern.

10. The device as claimed in claim 3, wherein the diffraction grating contours comprise a series of concentric circular shaped contours with a pitch of 100 microns.

* * * * *